US010526807B2

(12) United States Patent
Spicer et al.

(10) Patent No.: US 10,526,807 B2
(45) Date of Patent: Jan. 7, 2020

(54) LIFT ASSEMBLY AND SPA INCLUDING THE SAME

(71) Applicant: STRONG INDUSTRIES, INC., Northumberland, PA (US)

(72) Inventors: Wade Spicer, Northumberland, PA (US); John Joseph Cunerty, Toronto (CA); Gary Mark Comeau, Burlington (CA)

(73) Assignee: STRONG INDUSTRIES, INC., Northumberland, PA (US)

( * ) Notice: Subject to any disclaimer, the term of this patent is extended or adjusted under 35 U.S.C. 154(b) by 0 days.

(21) Appl. No.: 15/971,081

(22) Filed: May 4, 2018

(65) Prior Publication Data

US 2018/0313101 A1 Nov. 1, 2018

Related U.S. Application Data

(63) Continuation of application No. 14/713,193, filed on May 15, 2015, now abandoned.

(60) Provisional application No. 62/107,741, filed on Jan. 26, 2015, provisional application No. 62/074,301, filed on Nov. 3, 2014.

(51) Int. Cl.
*E04H 4/08* (2006.01)
*E05F 1/10* (2006.01)

(52) U.S. Cl.
CPC ..... *E04H 4/084* (2013.01); *E05F 1/1091* (2013.01); *E05Y 2900/602* (2013.01)

(58) Field of Classification Search
CPC ..... E05F 1/1091; E05Y 2900/602
USPC ..... 4/498, 500, 503
See application file for complete search history.

(56) References Cited

U.S. PATENT DOCUMENTS 4,853,985 A * 8/1989 Perry ..... B65F 1/1623 4/498
6,000,072 A 12/1999 LaHay
6,032,305 A 3/2000 Tedrick
6,601,834 B2 8/2003 Perry
6,938,281 B1 9/2005 Tudor
(Continued)

FOREIGN PATENT DOCUMENTS

CA 2421332 A1 9/2003
CN 203487817 U 3/2014
EP 2078811 * 12/2008 ..... E05F 1/1091

OTHER PUBLICATIONS

Canadian Office Action dated Oct. 5, 2018 issued in the corresponding Canadian Application No. 2,965,723.

*Primary Examiner* — J C Jacyna
(74) *Attorney, Agent, or Firm* — Grogan, Tuccillo & Vanderleeden, LLP

(57) ABSTRACT

A lift assembly for a spa cover is disclosed. The spa cover is for covering an open upper end of a spa. The lift assembly includes a lever arm having a first portion for supporting a spa cover, and a first end for pivotable coupling to a sidewall of a spa for rotation of the lever arm between a closed position in which the spa cover rests on the upper end of the spa, and an open position in which the spa cover is displaced from the upper end of the spa. The lift assembly also includes a resilient spring having a first end coupled to the lever arm, and a second end for coupling to the sidewall of the spa. In the open position of the lever arm, the spring urges the lever arm to rotate toward the closed position. A spa including the lift assembly is also disclosed.

11 Claims, 19 Drawing Sheets

(56) References Cited

U.S. PATENT DOCUMENTS

| | | | | |
|---|---|---|---|---|
| 8,516,626 | B2 * | 8/2013 | Gardenier | A61H 33/02 4/498 |
| 2003/0150054 | A1 | 8/2003 | Tudor | |
| 2011/0239360 | A1 * | 10/2011 | Gramatikopoulos | E04H 4/084 4/498 |
| 2013/0117922 | A1 | 5/2013 | Spicer | |

* cited by examiner

LIFT ASSEMBLY AND SPA INCLUDING THE SAME

CROSS REFERENCE TO RELATED APPLICATIONS

This application is a continuation of U.S. patent application Ser. No. 14/713,193 filed on May 15, 2015, which claims the benefit of U.S. Provisional Application No. 62/107,741, filed on Jan. 26, 2015, and U.S. Provisional Application No. 62/074,301, filed on Nov. 3, 2014, each of which are hereby incorporated by reference herein in their entireties.

FIELD OF THE INVENTION

This disclosure relates to the field of lift assemblies for spa covers.

INTRODUCTION

A spa, also referred to as a whirlpool or hot tub, is a large vessel for holding a volume of liquid (e.g. water or mud) and one or more user occupants. Typically, a user occupant sits or lies down in the spa while at least partially submerged in the liquid. This may provide a user occupant with, for example relaxation or therapy.

A spa may contain hundreds or even thousands of liters of liquid. Often, the liquid in the spa is heated to a temperature well above ambient, which may require considerable energy consumption. Accordingly, some spas may include an insulated cover, at least in part for preventing the escape of heat from the liquid.

SUMMARY

In one aspect, a spa is provided. The spa may comprise a housing, a cover, and at least a first lift assembly. The housing may define an interior chamber for containing a volume of water and one or more users. The chamber may have an open upper end for user entry. The cover may be positionable over the housing for covering at least a portion of the open upper end. The lift assembly may be operable to selectively remove and replace the cover over the open upper end of the housing. Each lift assembly may have a lever arm and a resilient spring. The lever arm may have a first portion coupled to the spa cover, and a first end pivotably coupled to a sidewall of the housing for rotation of the lever arm between a closed position in which the spa cover rests on the upper end of the spa, and an open position in which the spa cover is displaced from the upper end of the spa. The resilient spring may be positioned inside the housing behind the sidewall. The spring may have a first end drivingly coupled to the lever arm so that in the open position of the lever arm, the spring urges the lever arm to rotate toward the closed position.

DRAWINGS

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

Figure 1:
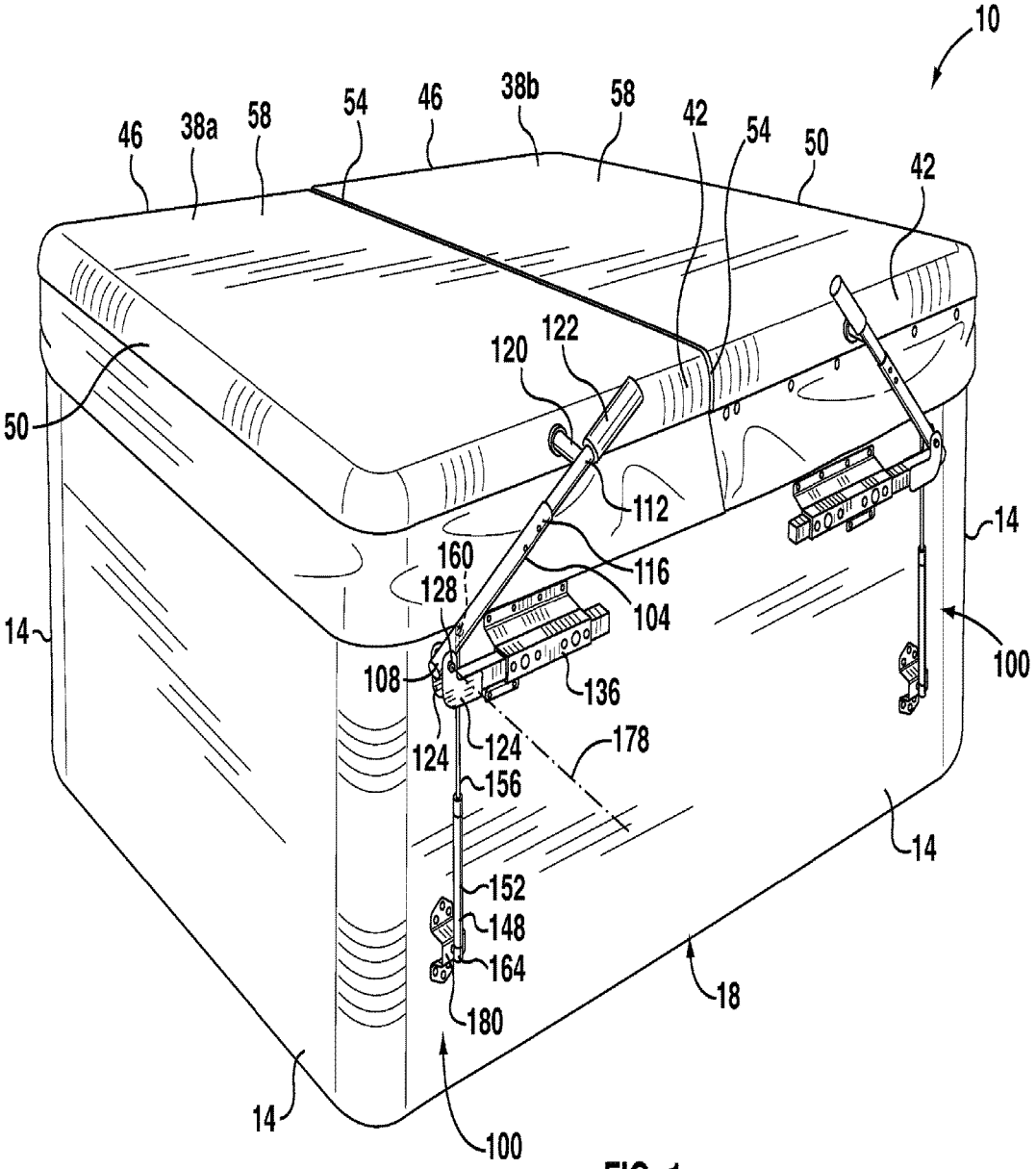
FIG. 1 shows a perspective view of a spa with a lift assembly and a cover in a closed position, in accordance with at least one embodiment.
Figure 2:
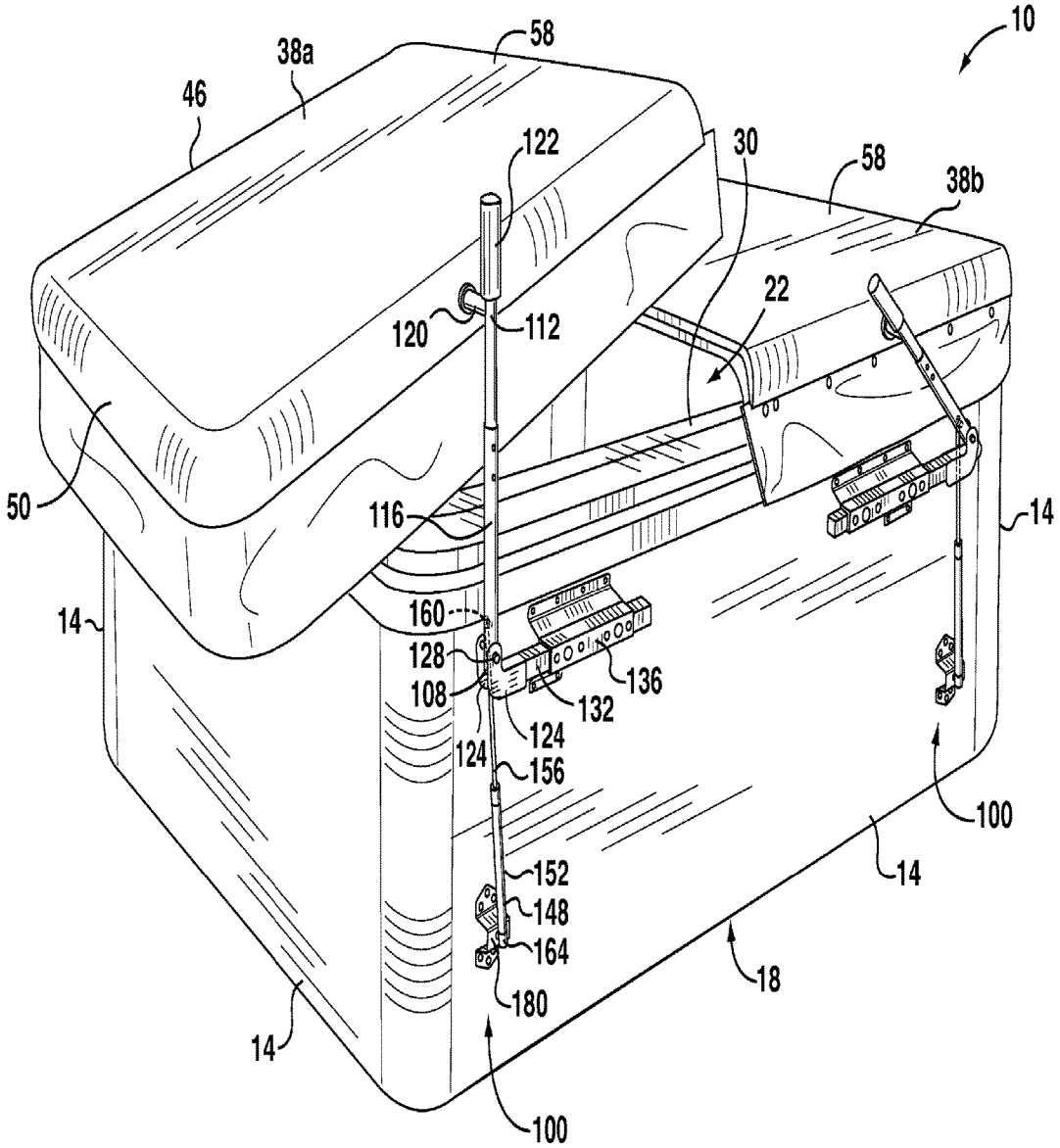
FIG. 2 shows a perspective view of the spa of FIG. 1 with the cover in an intermediate position, in accordance with at least one embodiment.
Figure 3:
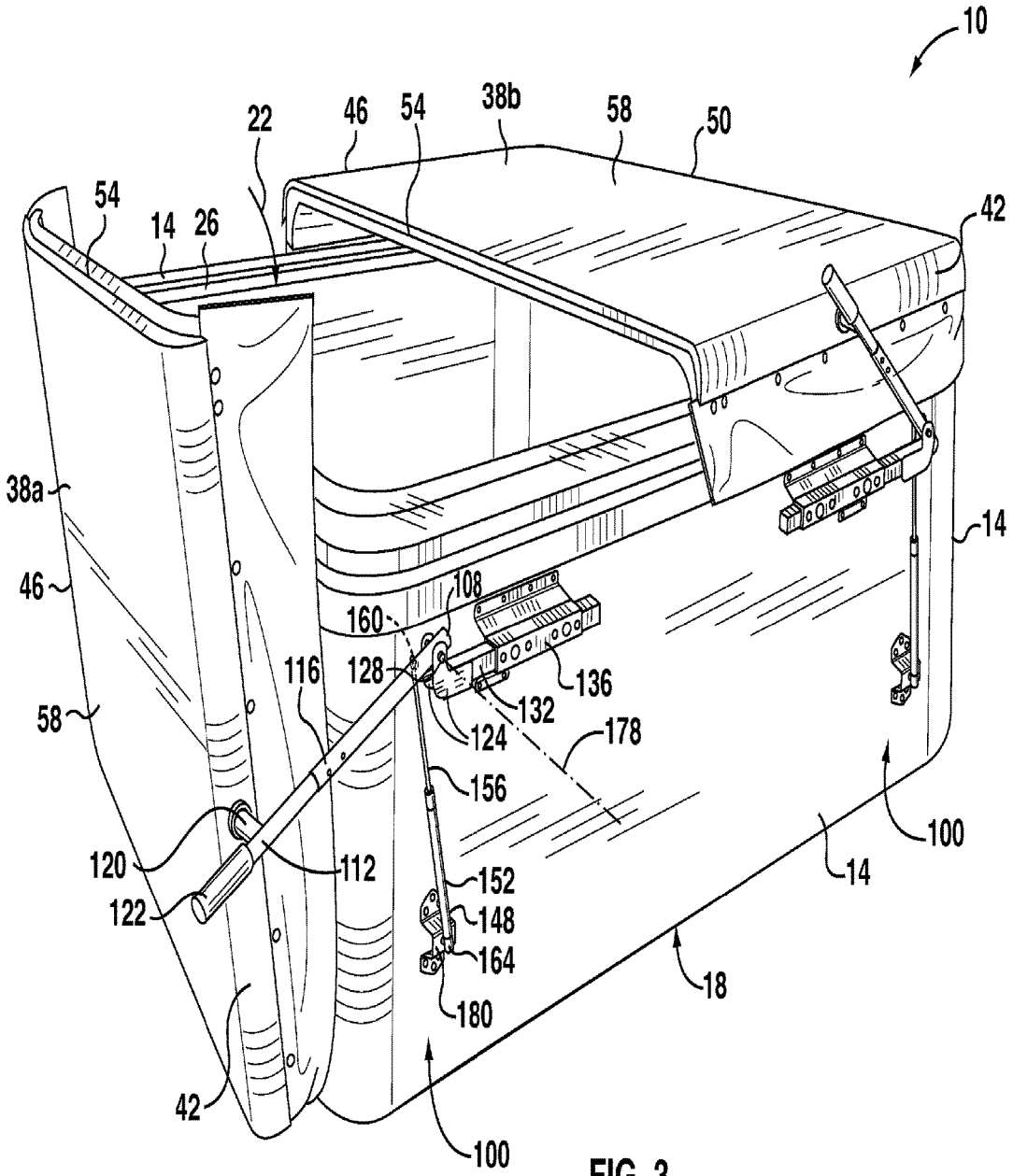
FIG. 3 shows a perspective view of the spa of FIG. 1 with the cover in an open position, in accordance with at least one embodiment.

FIGS. 1-3 show a spa 10 (also referred to as a hot tub or a whirlpool). As shown, spa 10 includes sidewalls 14 and a bottom 18, which collectively define an interior chamber 22 for containing a volume of water and one or more user occupants. Chamber 22 includes an open upper end 26 for user entry and exit.

Sidewalls 14 and bottom 18 may be configured to provide any suitable interior chamber 22. In the illustrated example, sidewalls 14 and bottom 18 define a rectangular footprint. In other embodiments, sidewalls 14 and bottom 18 may define a circular, triangular or other regular or irregularly shaped footprint.

In the illustrated example, chamber 22 is further defined by an inner tub 30 positioned above bottom 18 between sidewalls 14. As shown, inner tub 30 may be contoured to provide seating for user occupants of spa 10, as is known in the art. Further, spa 10 may include one or more jets which extend through tub 30 for project air and water into chamber 22 below the water level inside the spa 10. It will be appreciated that in some embodiments, tub 30 may be integrally formed with one or more of sidewalls 14 and bottom 18.

Spa 10 includes covers 38*a* and 38*b*. Each cover 38 is positionable over the open upper end 26 of chamber 22 for covering at least a portion of the open upper end 26. In the illustrated example, each cover 38 is equally sized and shaped to cover one half of the open upper end 26 of chamber 22. In alternative embodiments, each cover 38 may be differently sized and/or shaped to cover differently sized and/or shaped portions of the open upper end 26 of chamber 22. In some embodiments (not shown), spa 10 may include just one cover 38 sized to cover the entire open upper end 26.

Each cover 38 may be movable between a closed position (shown by example in FIG. 1), in which the cover 38 rests on the open upper end 26, and an open position (shown by example in FIG. 3), in which the cover 38 is displaced from the open upper end 26. For example, covers 38 may be moved to their respective open positions to provide user access to chamber 22 through upper end 26, and moved to their respective closed positions after all users have exited the chamber 22.

In the closed position, covers 38 may substantially seal chamber 22, and the water contained therein, from the external environment to mitigate entry of dirt/debris and loss of heat. A spa may be sized to hold hundreds or even a thousand liters of water (or other liquid, e.g. mud). Further, the water inside may be heated to temperatures of up to 40° C. or higher. The energy consumption required to heat such volumes of water is significant. Therefore, a spa cover may be configured to provide insulation against heat loss, thus accelerating water heating and conserving water temperature for future usage.

In the illustrated example, covers 38 may be from several inches to a foot or more thick (e.g. 4-20 inches) to provide the desired insulating properties. Further, each cover 38 may weigh from tens of pounds (e.g. 20-90 lbs) to a hundred pounds or more. This may make moving the cover 38 between the closed and open positions difficult for a user.

In the illustrated example, each cover 38 is connected to at least one lift assembly 100. Lift assemblies 100 are user operable for selectively removing and replacing covers 38 over the upper end 26 of chamber 22. Preferably, lift assemblies 100 reduce the force required from a user to move covers 38 from the open position to the closed position, and optionally from the closed position to the open position. A lift assembly 100 may supplement user-applied force to a cover 38 to reduce the effective weight of the cover 38 for a user moving the cover 38 between the open and closed positions.

As exemplified, each lift assembly 100 includes a lever arm 104 for directing the movement of the connected cover 38 between the open and closed positions. Lever arm 104 is shown including a first end 108 pivotally connected to a sidewall 14 of spa 10, and a first portion 112 spaced apart from the first end 108 and connected to a cover 38. In use, the first portion 112 may be rotated about the first end 104 for moving the connected cover 38 in an arcuate motion between the open and closed positions.

In the illustrated example, first portion 112 is a second end of lever arm 104. As shown, lever arm 104 may extend from a first end 108 pivotally connected to sidewall 14 to an opposite second end 112 connected to cover 38. Lever arm 104 may extend between first end 108 and second end 112 in any suitable fashion. As exemplified, lever arm 104 includes an intermediate portion 116 which extends between first and second ends 108 and 112 in a plane that is substantially vertical (e.g. substantially parallel to sidewall 14 and gravity).

Second end 112 of lever arm 104 may be pivotally connected to sidewall 14 of cover 38 in any suitable fashion. In the illustrated example, second end 112 includes a connecting portion 120 that extends substantially horizontally (e.g. substantially perpendicular to gravity) and substantially perpendicularly to intermediate portion 116 toward cover 38. As shown, connecting portion 120 may penetrate sidewall 14 cover 38 to form a rotatable connection with cover 38. Intermediate portion 116 may extend as shown from first end 108 to connecting portion 120.

Optionally, lever arm 104 may further include a handle 122 that a user may grasp while manipulating lever arm 104 between the closed and open positions. In the illustrated example, second end 112 includes handle 122. As exemplified, handle 122 may extend outboard of connecting portion 120. That is the distance between handle 122 and first end 108 may be greater than the distance between connecting portion 120 and first end 108. This may provide a user operating lever arm 104 with a mechanical advantage. Preferably, handle 122 extends above an upper end 58 of cover 38 as shown. This may provide a handle 122 for a user to grasp and manipulate lever arm 104 between the closed and open positions. In alternative embodiments, handle 122 may not extend above upper end 58 of cover 38.

Each cover 38 may extend in width across spa 10 from a first cover side 42 to an opposite second cover side 46. As shown, first portion 112 of lever arm 104 of lift assembly 100 may be connected to cover 38 at first cover side 42. In some embodiments, a second lift assembly 100 may be connected to cover 38 at second cover side 46. In some embodiments, lever arms 104 of first and second lift assemblies 100 are joined to form a unitary lever arm 104 that extends across a full width of the spa cover 38. For example, lever arms 104 may extend through an interior of cover 38 from first cover side 42 to second cover side 46. Alternatively, lever arms 104 may extend above or below cover 38, and the lever arms 104 may be connected to cover 38 in any suitable fashion (e.g. by screws, bolts, welds, rivets, or straps).

Lever arm 104 is preferably sized and positioned relative to sidewall 14 and cover 38 to provide clearance for cover 38 to move between the open and closed positions. As shown, cover 38 may be oriented substantially horizontally over chamber 22 in the closed positioned, and substantially vertically outboard of sidewall 14 in the open position. In the illustrated example, first portion 112 of lever arm 104 is rotatably connected to cover 38 to permit cover 38 to change orientations between the open and closed positions.

Lever arm 104 may be pivotally connected to sidewall 14 of spa 10 in any suitable fashion. In the illustrated example, lever arm 104 is pivotally connected between a pair of mounting plates 124 by a pin 128 for rotation about a substantially horizontal axis.

Mounting plates 124 may be directly or indirectly connected to spa sidewall 14. In some embodiments, lift assembly 100 may be a retrofit kit adaptable to spas of different sizes and shapes. In this case, it may be desirable to provide a pivoting connection between lever arm 104 and sidewall 14 that is easily repositionable. In the illustrated example, mounting plates 124 are rigidly secured to a horizontal mounting beam 132. In turn, the mounting beam 132 is slideably receivable in a mounting bracket 136 that is rigidly fastened to sidewall 14.

Preferably, mounting beam 132 is selectively securable to mounting bracket 136 at a plurality of different positions. For example, a hole may be formed in mounting beam 132 that can be selectively aligned with one of an array of holes formed in mounting bracket 136 by selectively positioning mounting beam 132 relative to mounting bracket 136. In this case, a screw, bolt or other fastener may be inserted into the aligned holes to rigidly secure the mounting beam 132 to the mounting bracket 136. In alternative embodiments, mounting beam 132 may be selectively securable to mounting bracket 136 in a different suitable fashion. For example, the array of holes in the previous example may be substituted by a slot.

Mounting bracket 136 may be rigidly fastened to sidewall 14 in any suitable fashion, such as by welds, bolts, screws, or rivets for example. Preferably, mounting bracket 136, mounting beam 132, and mounting plates 124 are immovable relative sidewall 14 when rigidly connected together and to sidewall 14. As used herein and in the claims, two elements that are "rigidly connected" are immovable relative to each other when so rigidly connected.

Figure 4:
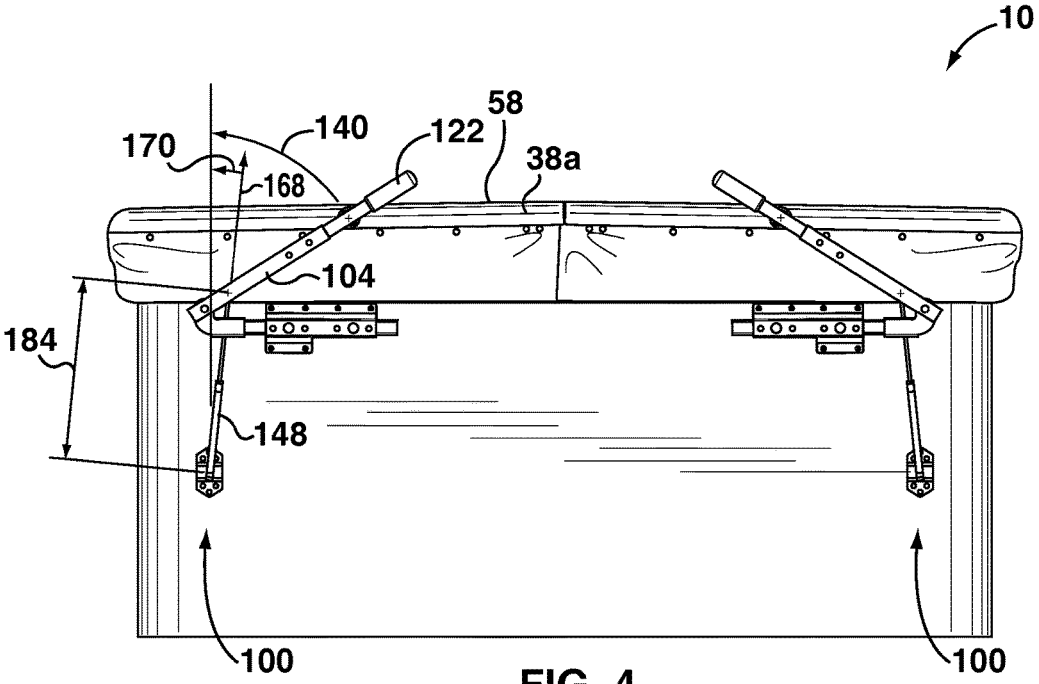
FIG. 4 shows a front elevation view of the spa of FIG. 1 in the closed position.

Turning to FIGS. 1 and 4, lever arm 104 may extend at a (non-zero) angle 140 to vertical when in the closed position. Preferably, angle 140 is 20-80 degrees, and more preferably 30-70 degrees. In the illustrated example, angle 140 is approximately 60 degrees. In use, moving lever arm 104 from the closed position toward the open position includes rotating first portion 112 about first end 108 upwardly toward a vertical orientation. For example, moving cover 38 from the closed position toward the open position may include raising cover 38 vertically from chamber 22 and horizontally to an intermediate position shown by example in FIGS. 2 and 6.

In the intermediate position, lever arm 104 may extend substantially vertically, or more generally, first portion 112 may be substantially vertically aligned above first end 108. Also, cover end 50 may extend outboard of sidewall 14 as shown.

Figure 8:
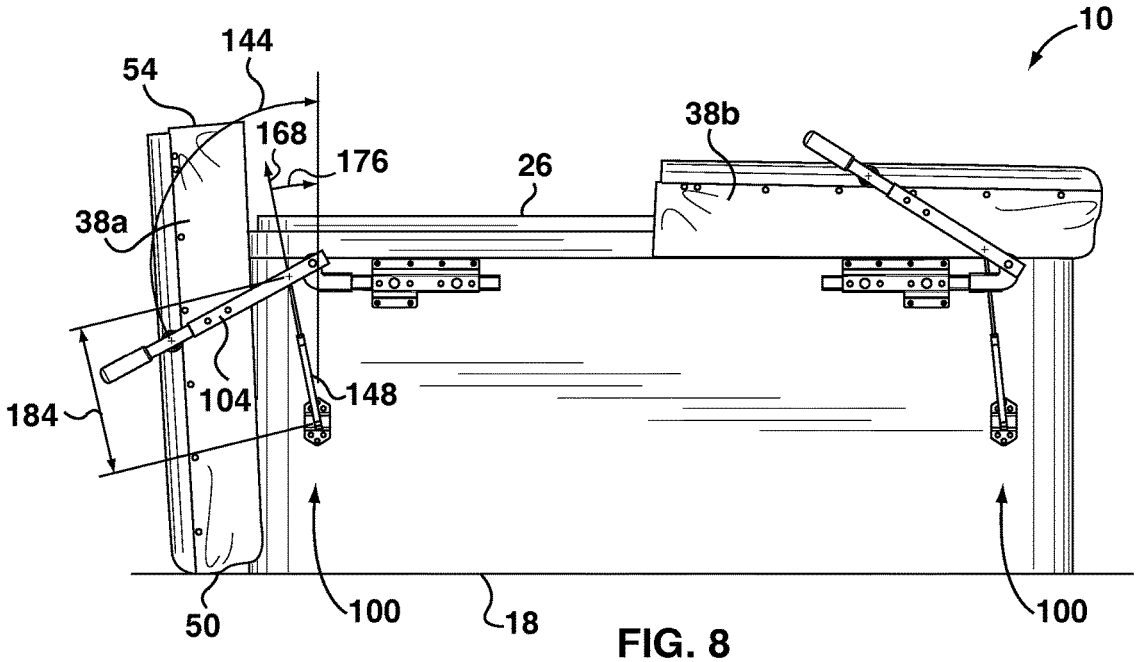
FIG. 8 shows a front elevation view of the spa of FIG. 1 in the open position.
Figure 9:
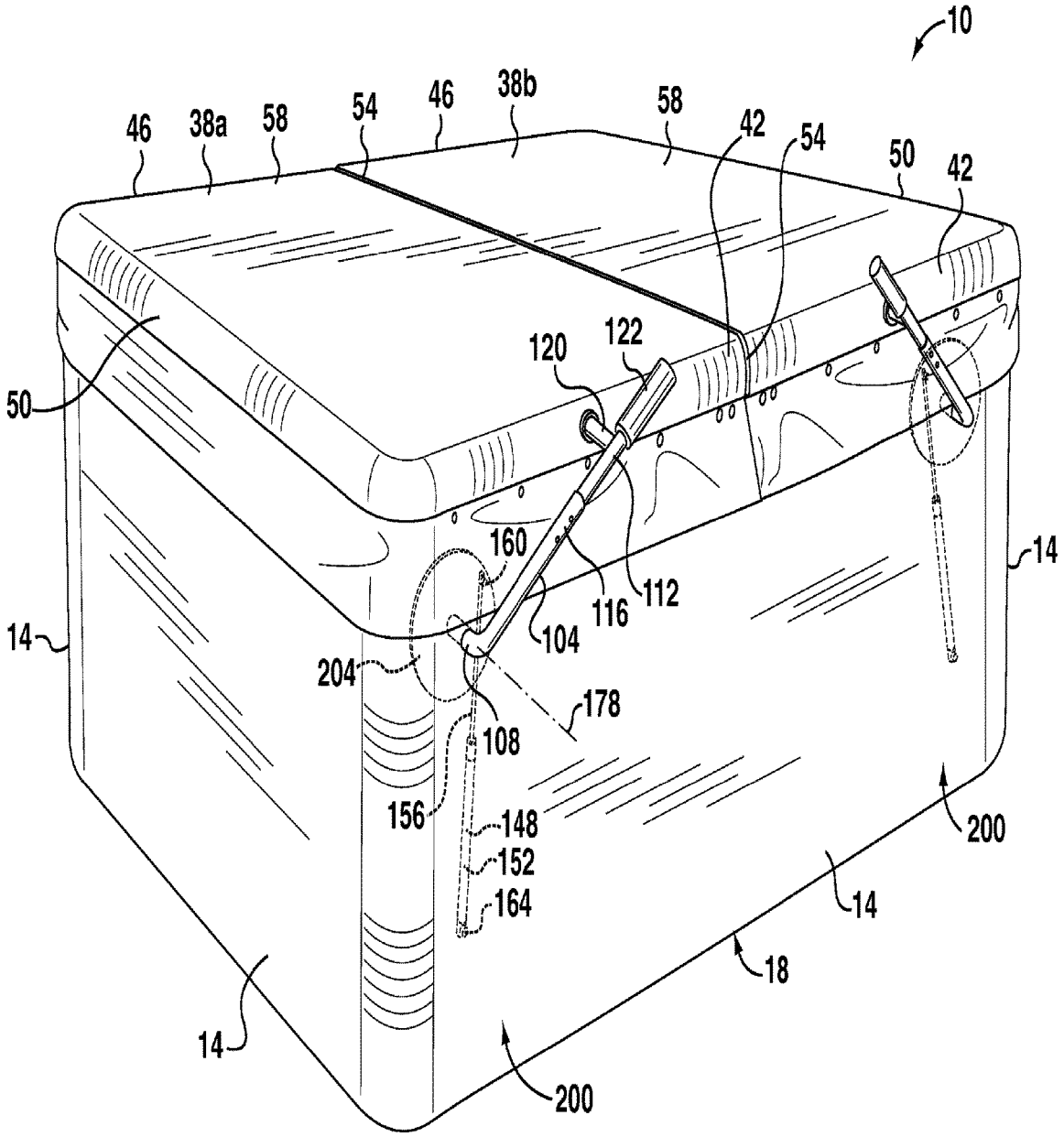
FIG. 9 shows a perspective view of a spa with another lift assembly and a cover in a closed position, in accordance with another embodiment.
Figure 10:
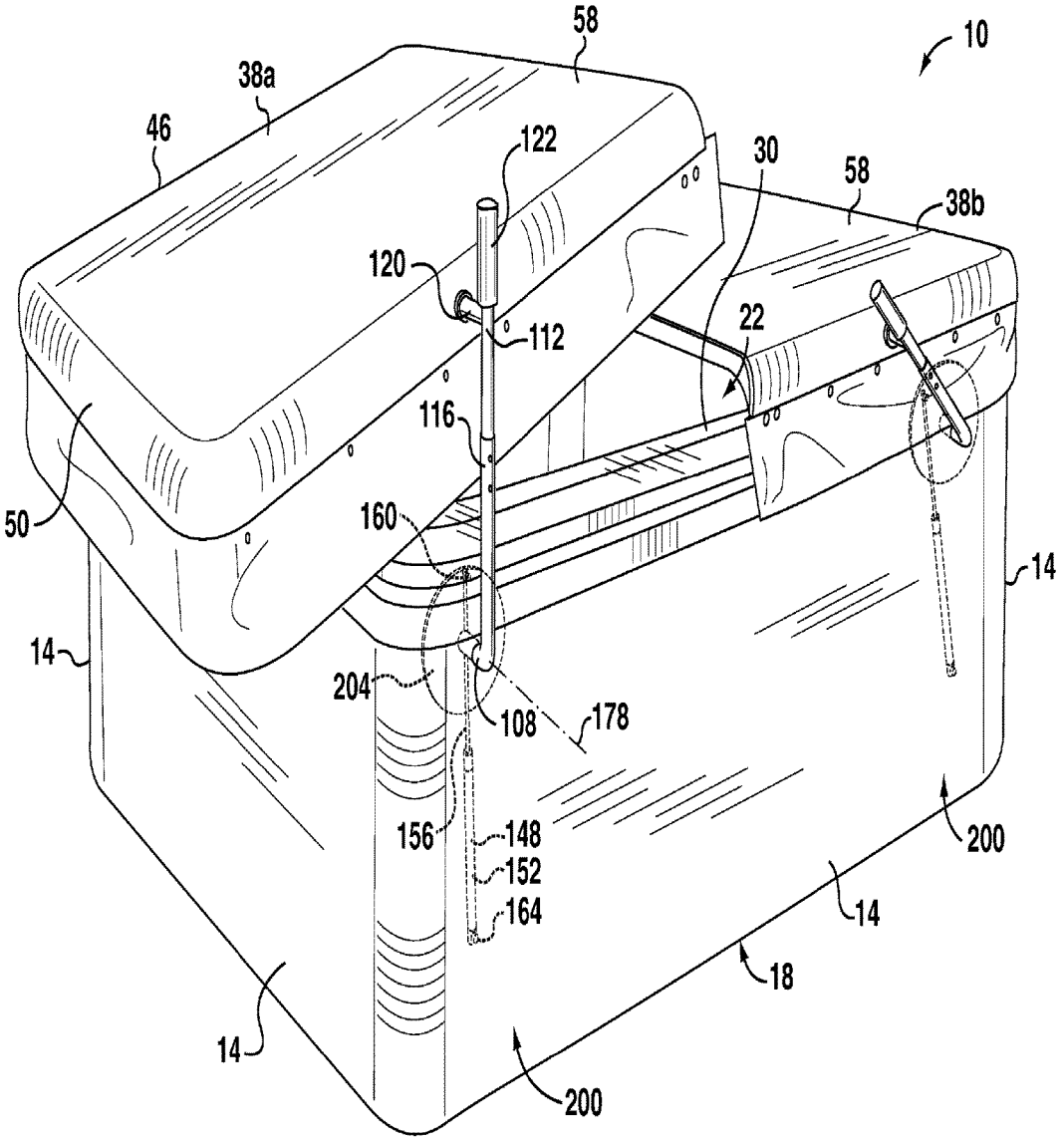
FIG. 10 shows a perspective view of the spa of FIG. 9 with the cover in an intermediate position, in accordance with at least one embodiment.
Figure 11:
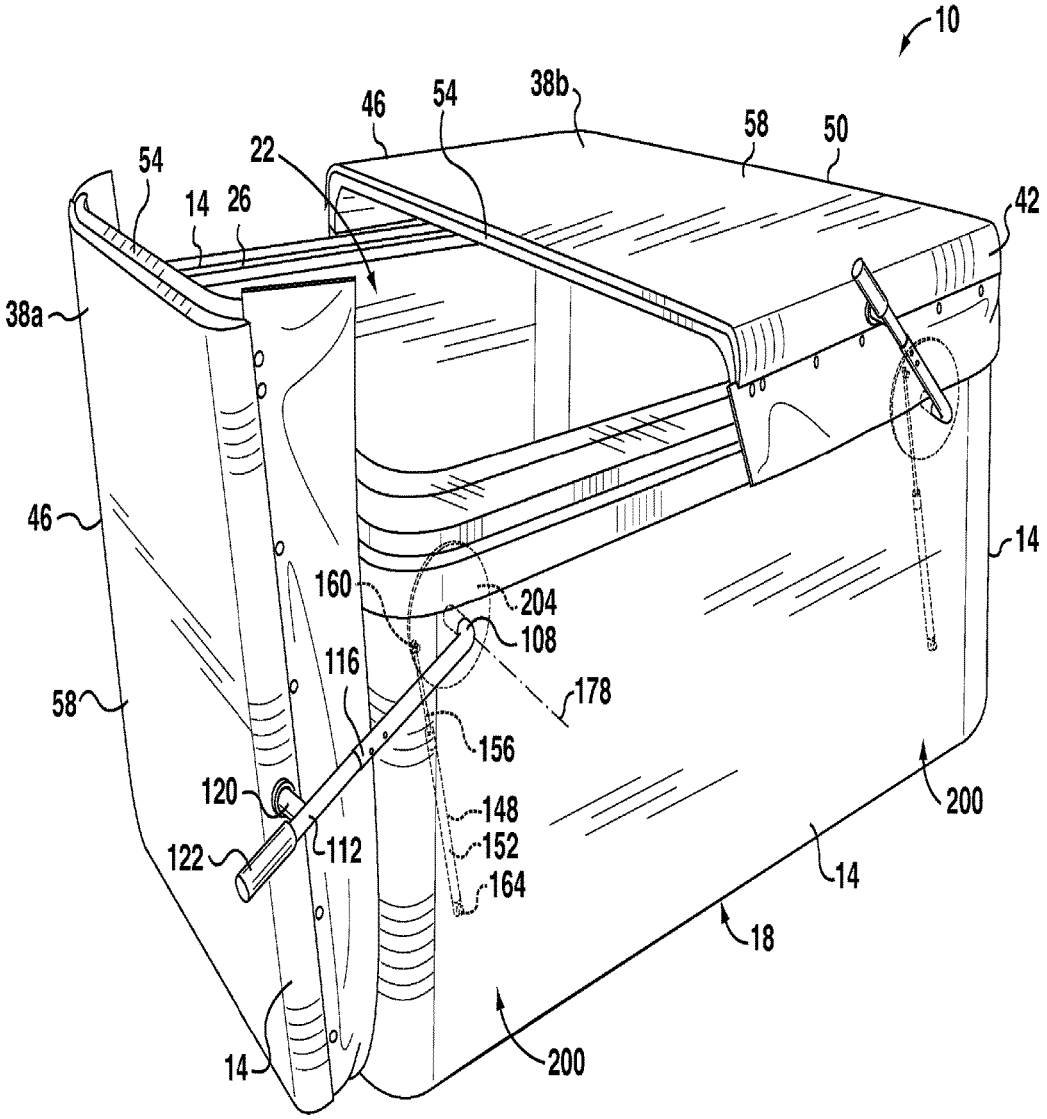
FIG. 11 shows a perspective view of the spa of FIG. 9 with the cover in an open position, in accordance with at least one embodiment.
Figure 12:
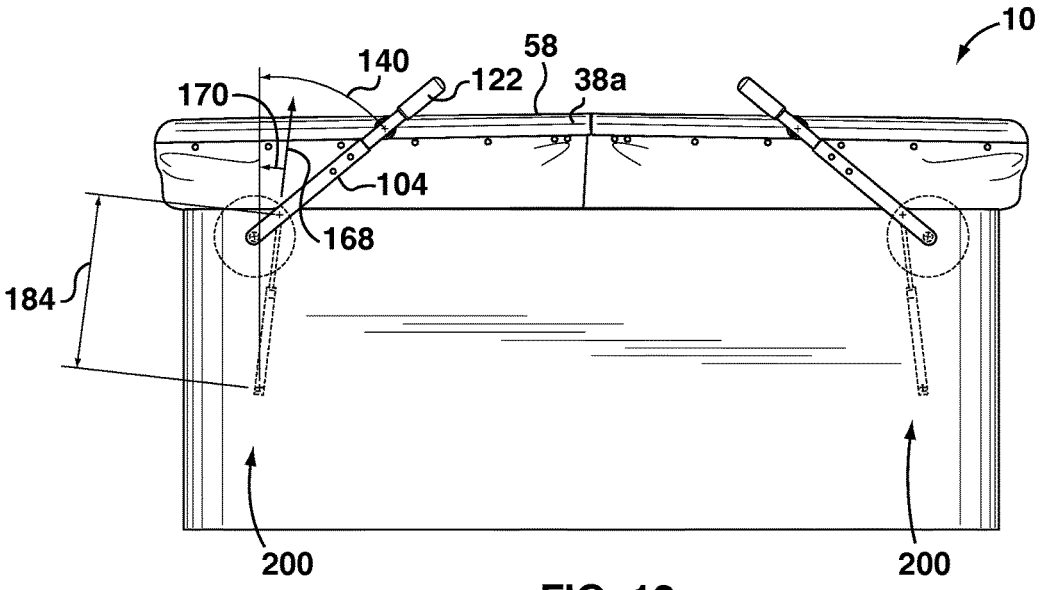
FIG. 12 shows a front elevation view of the spa of FIG. 1 in the closed position.
Figure 13:
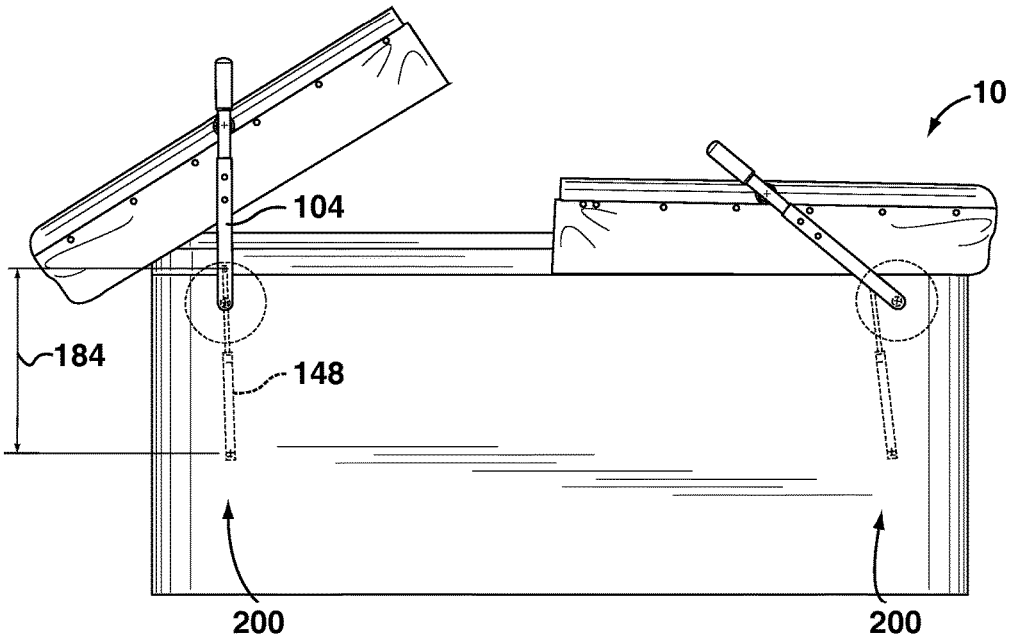
FIG. 13 shows a front elevation view of the spa of FIG. 1 in the intermediate position.
Figure 14:
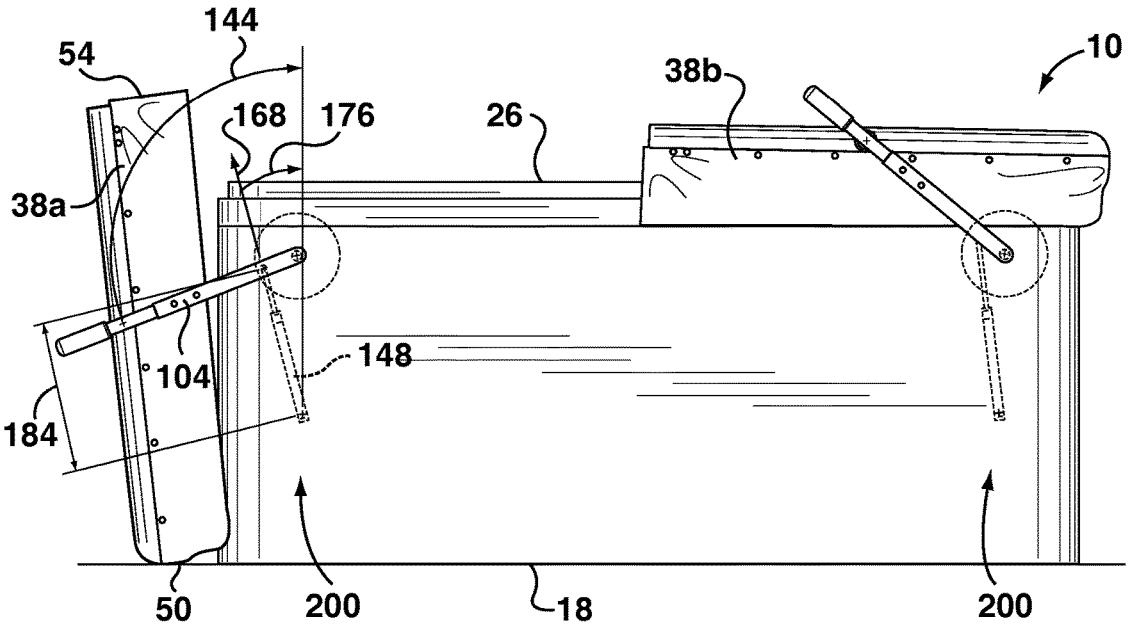
FIG. 14 shows a front elevation view of the spa of FIG. 1 in the open position.

Turning to FIGS. 3 and 8, lever arm 104 may be further rotated past the intermediate position to the open position. As shown, lever arm 104 may extend at a (non-zero) angle 144 to vertical in the open position. Preferably, angle 144 is 20-150 degrees, and more preferably 45-120 degrees, and most preferably 90-110 degrees. In the illustrated example, angle 144 is approximately 100 degrees. Preferably, cover 38 is positioned outboard of sidewall 14 of spa 10 in the open position. Also, cover 38 may be oriented substantially vertically in the open position, with outboard cover end 50 positioned vertically below inboard cover end 54. Preferably, outboard cover end 50 is positioned level with the bottom 18 of spa 10 in the open position as shown. This may reduce or eliminate the height of inboard cover end 54 above upper end 26 to reduce the visual obstruction of cover 38 in the open position.

In the illustrated example, moving cover 38 from the closed position to the open position includes lifting cover 38 upwardly from the closed position to the intermediate position and then lowering cover 38 from the intermediate position to the open position. Similarly, moving cover 38 from the open position to the closed position includes lifting cover 38 upwardly from the open position to the intermediate position and then lowering cover 38 from the intermediate position to the closed position. In both cases, the size and weight of cover 38 may make it difficult to lift and lower cover 38 easily and in a controlled fashion.

Lift assembly 100 may be configured to make cover 38 effectively lighter for a 30 user, which may make lifting and lowering cover 38 easier. Lift assembly 100 may include a resilient spring for supporting at least a portion of the weight of cover 38 in the open position and optionally the closed position. The spring may be any suitable spring, such as a pneumatic spring 148 as shown, or a coil spring (not shown) for example.

Pneumatic spring 148 may be any suitable pneumatic spring known in the art.

As shown, pneumatic spring 148 includes a sealed pneumatic cylinder 152 and an axially aligned piston rod 156. Pneumatic spring 148 is compressible in length by moving piston rod 156 axially into pneumatic cylinder 152. Pneumatic spring 148 is also extensible in length by moving piston rod 156 axially outwardly from pneumatic cylinder 152.

Pneumatic spring 148 may be double acting or single acting. A double acting pneumatic spring 148 has an equilibrium position from which the spring 148 resiliently resists compression and extension and from which position the pneumatic 148 can compress and extend. When compressed, the spring 148 develops an extensive force, and when extended the spring 148 develops a retractive force.

Preferably, spring 148 is single acting. A single acting spring 148 is configured to develop either extensive or retractive forces but not both. This may permit spring 148 to be configured to provide a minimum retractive or extensive force across the full range of contraction/extension of the spring 148. For example, pneumatic spring 148 may be biased to full extension or full retraction when in a relaxed state.

In the illustrated example, spring 148 has a first end 160 pivotably coupled to lever arm 104 and a second end 164 pivotably coupled to sidewall 14. In some embodiments, spring 148 may urge lever arm 104 to rotate toward the open position when lever arm 104 is between the closed position and the intermediate position. This may have the effect of assisting with lifting cover 38 from the closed position to the intermediate position. This may also have the effect of slowing the descent of cover 38 under gravity from the intermediate position to the closed position.

Figure 5:
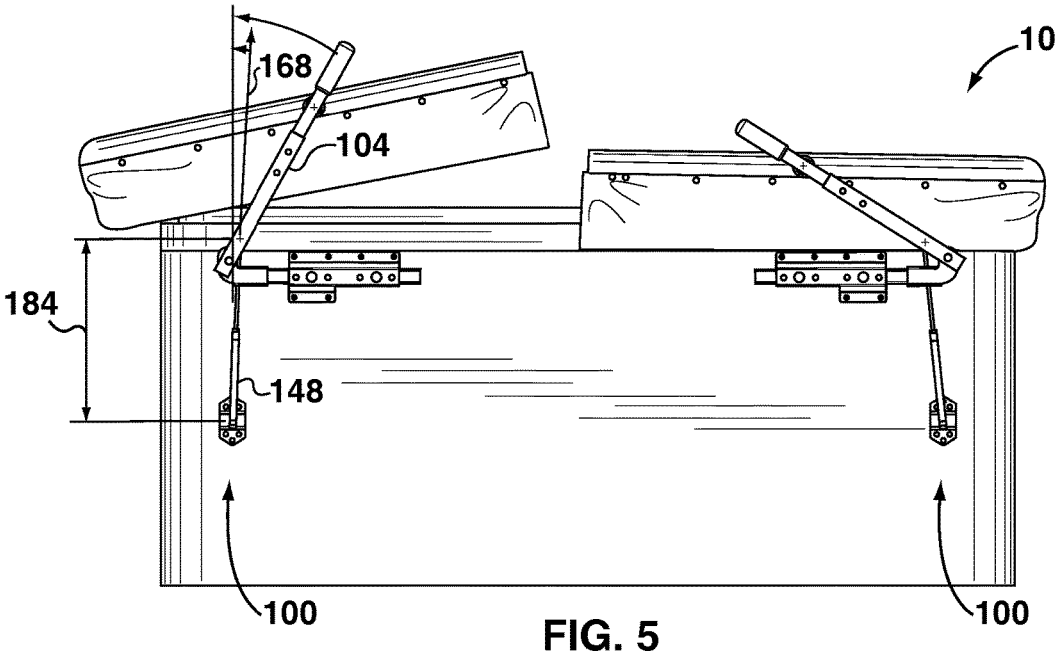
FIG. 5 shows a front elevation view of the spa of FIG. 1 in between the closed and intermediate positions.
Figure 6:
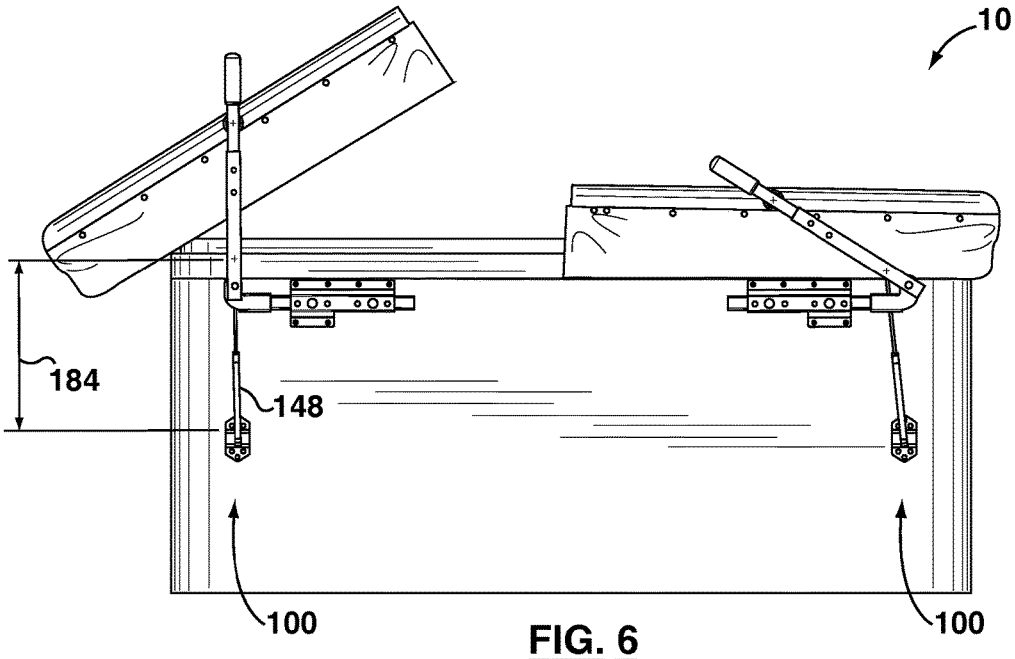
FIG. 6 shows a front elevation view of the spa of FIG. 1 in the intermediate positions.

As exemplified, first end 160 of spring 148 may be pivotally coupled to lever arm 104 between first end 108 and first portion 112 of lever arm 104, and second end 164 of spring 148 may be pivotally coupled to sidewall 14 below lever arm 104. Spring 148 may be in a compressed state when lift assembly 100 is in the closed position such that spring 148 applies an extensive force onto lever arm 104 which urges lever arm 104 toward the open position. More specifically, and with reference to FIG. 4, spring 148 may be oriented to apply an extensive force in a direction 168 that forms an angle 170 to vertical that is less than angle 140 between lever arm 104 and vertical. In the illustrated example, angle 170 may be between 0 and 70 degrees, and more preferably 0 to 30 degrees and most preferably 0 to 15 degrees. In some embodiments, direction 148 may be substantially vertical and therefore form a zero angle with vertical. As illustrated in FIGS. 4-6, length 184 of spring 148 may increase continuously from the closed position in FIG. 4 to the intermediate position in FIG. 6.

Preferably, the extensive force which may be exerted by spring 148 to urge lever arm 104 from the closed position toward the open position is insufficient to lift cover 38 against the weight of gravity. This may prevent spring 148 from opening cover 38 inadvertently without user input. Instead, the extensive force which may be applied by spring 148 may offset a portion of the weight of cover 38 to reduce user effort required to lift cover 38 from the closed position. Spring 148 may reduce user effort required to lift cover 38 from the closed position by 20-95%, or more preferably by 30-85% compared with having no spring 148, where user effort is measured in units of force (e.g. Newtons).

Figure 7:
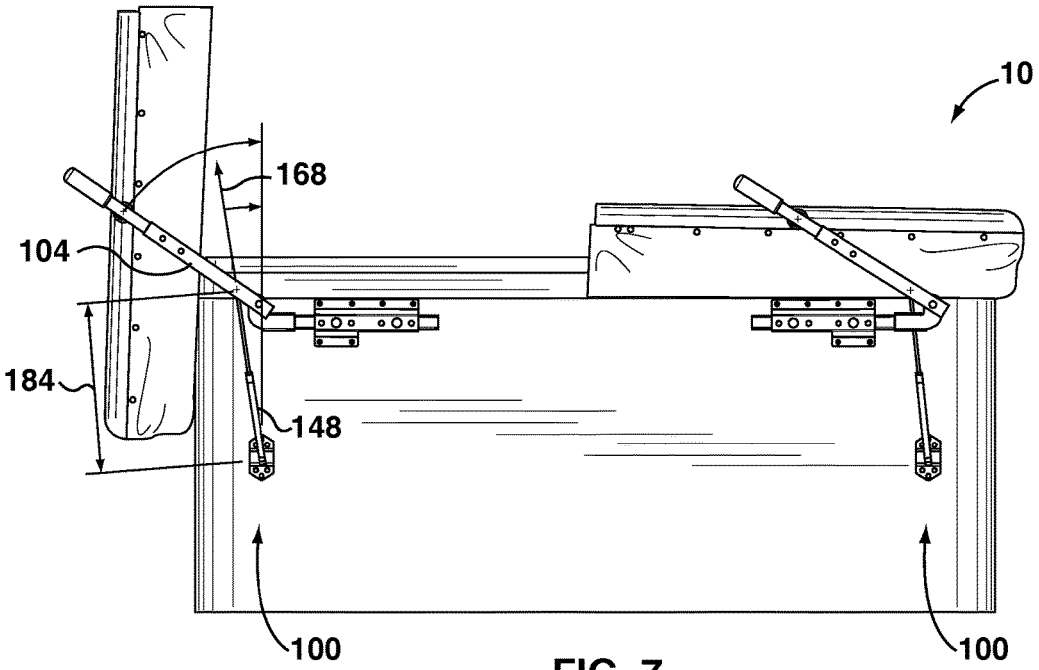
FIG. 7 shows a front elevation view of the spa of FIG. 1 in between the intermediate and open positions.

As exemplified, spring 148 may be in a compressed state when lift assembly 100 is in the open position, such that spring 148 applies an extensive force onto lever arm 104, which urges lever arm 104 toward the closed position. More specifically and with reference to FIG. 8, spring 148 may be oriented to apply an extensive force in a direction 168 that forms an angle 176 to vertical, where angle 176 is less than angle 144 between lever arm 104 and vertical. In the illustrated example, angle 176 may be between −30 to 140 degrees, more preferably 0 to 100 degrees, and most preferably 10 to 40 degrees. As illustrated in FIGS. 6-8, length 184 of spring 148 may increase continuously from the open position in FIG. 8 to the intermediate position in FIG. 6.

Preferably, the extensive force which may be exerted by spring 148 to urge lever arm 104 from the open position toward the closed position is insufficient to move cover 38 against the weight of gravity. This may prevent spring 148 from closing cover 38 inadvertently without user input. Instead, the extensive force which may be applied by spring 148 may offset a portion of the weight of cover 38 to reduce user effort required to lift cover 38 from the open position. Spring 148 may reduce user effort required to lift cover 38 from the open position by 20-95%, or more preferably by 30-85% compared with having no spring 148, where user effort is measured in units of force (e.g. Newtons).

In alternative embodiments, first end 160 of spring 148 may be pivotally connected to lever arm 104 outboard of the axis of rotation 178 at first end 108 (i.e. away from first portion 112). In this case, pneumatic spring 148 may be in an extended state to exert a retractive force on lever arm 104 when lever arm 104 is in the open and/or closed positions to urge lever arm 104 toward the opposite open or closed position.

In further alternative embodiments, spring 148 may be pivotally connected to lever arm 104 and oriented to exert a retractive force on lever arm 104 when lever arm 104 is in the closed position to urge lever arm 104 toward the open position, and/or to exert an extensive force on lever arm 104 when lever arm 104 is in the open position to urge lever arm 104 toward the closed position.

In another alternative embodiment, spring 148 may be pivotally connected to lever arm 104 and oriented to exert an extensive force on lever arm 104 when lever arm 104 is in the closed position to urge lever arm 104 toward the open position, and/or to exert a retractive force on lever arm 104 when lever arm 104 is in the open position to urge lever arm 104 toward the closed position.

In some embodiments, spring 148 may continuously urge lever arm 104 toward the open position when lever arm 104 is anywhere between the closed position and the intermediate position. Further, spring 148 may continuously urge lever arm 104 toward the closed position when lever arm 104 is anywhere between the open position and the intermediate position. This may permit spring 148 to assist with lifting and lowering cover 38 across the full range of motion between the open and closed positions.

Second end 164 of spring 148 may be pivotally connected to sidewall 14 in any suitable fashion. In the illustrated example, second end 164 of spring 148 is pivotally connected to a mounting bracket 180, and the mounting bracket 180 is rigidly connected to sidewall 14. In alternative embodiments, second end 164 of spring 148 may be pivotally connected directly to sidewall 14.

First end 160 of spring 148 may be pivotally connected to lever arm 104 in any suitable fashion. In the illustrated example, first end 160 of spring 148 is pivotally connected to lever arm 104 by a ball stud. In alternative embodiments, first end 160 of spring 148 may be pivotally connected to a clamp that is rigidly connected to lever arm 104.

In some embodiments, one or more components of a lift assembly may be positioned behind the sidewall 14 of spa 10. This may permit the sidewall 14 to protect these components against weather, dirt, and damage. This may also reduce the incidence of injury, e.g. from pinching fingers in moving components of the lift assembly.

Reference is now made to FIGS. 9 to 14, where like part numbers refer to like parts in the previous figures, and where a spa 10 including a lift assembly 200 is shown.

Lift assembly 200 is similar to lift assembly 100 in many respects except, for example that some components of lift assembly 200 are positioned behind sidewall 14 of spa 10.

In the illustrated example, lift assembly 200 is shown including a lever arm 104 which extends outside of sidewall 14, and a pneumatic spring 148 positioned behind sidewall 14. This may provide user-access to lever arm 104 for moving lever arm 104 between the closed position (FIGS. 9 and 12) and the open position (FIGS. 11 and 13), while covering pneumatic spring 148 against weather, dirt, and damage. It will be appreciated that in alternative embodiments, pneumatic spring 148 may be substituted by any suitable resilient spring such as a linear coil spring or a torsional spring.

Spring 148 may be drivingly coupled to lever arm 104 in any suitable fashion.

For example, spring 148 may be coupled to a driving member (e.g. an arm, disk, or sprocket) which is in turn coupled to lever arm 104. In the illustrated example, first end 108 of lever arm 104 is bent to extend through sidewall 14. As shown, a disk 204 is rigidly connected to first end 108 behind sidewall 14 for common rotation with lever arm 104 about axis 178. Preferably, disk 204 extends in a plane substantially perpendicular to axis 178.

As exemplified, first end 160 of spring 148 may be pivotally connected to disk 204.

First end 160 of spring 148 may be pivotally connected at any suitable position on disk 204. Preferably, first end 160 may be pivotally connected to disk 204 at a position radially outboard of first end 108. As exemplified, first end 160 may be aligned with intermediate portion 116 of arm 104 when viewed in profile in a direction parallel to axis 178. The angular relationship between spring 148 and lever arm 104 may be as described above with reference to lift assembly 100 and angles 140, 144, 170, and 176 (see FIGS. 12-14).

Second end 164 of spring 148 may be pivotally mounted to spa 104 in any suitable fashion. For example, second end 164 may be pivotally mounted to sidewall 14 or another stationary component of spa 104.

It will be appreciated that lever arm 104 and the driving member may be discrete components that are connected together, or a single integrally formed component. For example, lever arm 104 and disk 204 may be discrete elements which are rigidly connected as shown, or integrally formed as one component. Further, it will be appreciated that disk 204 may be substituted by another suitable driving member. For example, in an alternative embodiment, disk 204 may be an arm which extends from first end 108 of lever arm 104. In this example, first end 108 and the arm may form a U-shape.

First end 108 of lever arm 104 may be pivotally connected to spa 14 for rotation about axis 178 in any suitable fashion. For example, a bushing or bearing (not shown) may be provided in the opening of sidewall 14 where first end 108 penetrates sidewall 14.

The operation of lift assembly 200 may be substantially similar to lift assembly 100. For example, spring 148 may act upon disk 204 to urge lever arm 104 from the closed position to the open position, and to urge lever arm 104 from the open position to the closed position.

Figure 15:
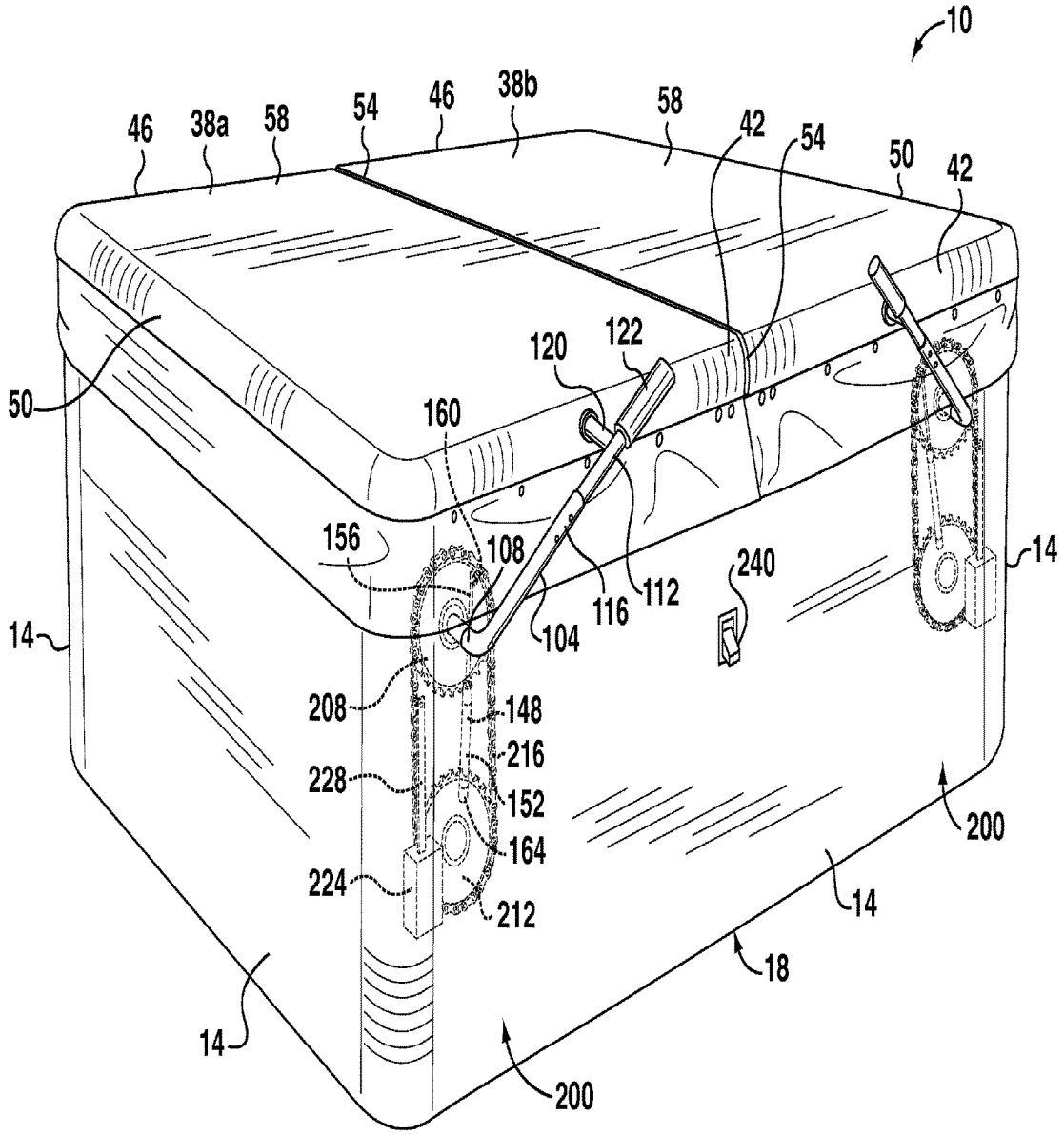
FIG. 15 shows a perspective view of a spa with another lift assembly and a cover in a closed position, in accordance with another embodiment.
Figure 16:
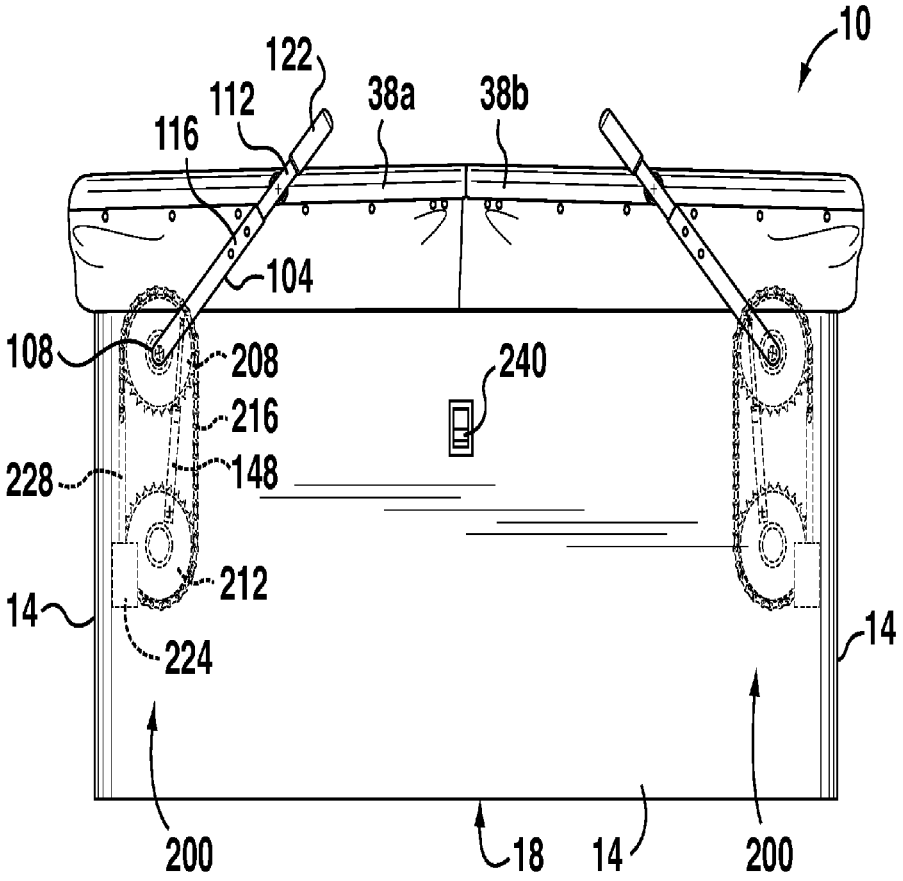
FIG. 16 shows a front elevation view of the spa of FIG. 15, in the closed position.

Reference is now made to FIGS. 15 and 16. In some embodiments, lift assembly 200 may include a rotator, such as a linear or rotary motor or fluidly driven piston cylinder (pneumatic or hydraulic), for automatically moving the lever arm 104 between the open and closed positions. In the illustrated example, disk 204 is replaced by a first sprocket 208, and lift assembly 200 further includes a second sprocket 212. As shown, first and second sprockets 208 and 212 may be drivingly coupled by a chain 216. This may permit first sprocket 208 to be driven by manipulating chain 216 or second sprocket 212.

Second sprocket 212 may be positioned at any suitable location. Preferably, second sprocket 212 is positioned behind sidewall 14 in spaced apart relation to first sprocket 208. As exemplified, lift assembly 200 may include a linear motor 220 drivingly coupled to chain 216 for driving first sprocket 208 to rotate between the open and closed positions. For example, motor 220 may include a linear drive shaft 224 having a free end 228 connected to chain 216. In use motor 220 may be operable to extend and retract drive shaft 224 to move chain 216 thus rotating first sprocket 208 between the open and closed positions.

Figure 17:
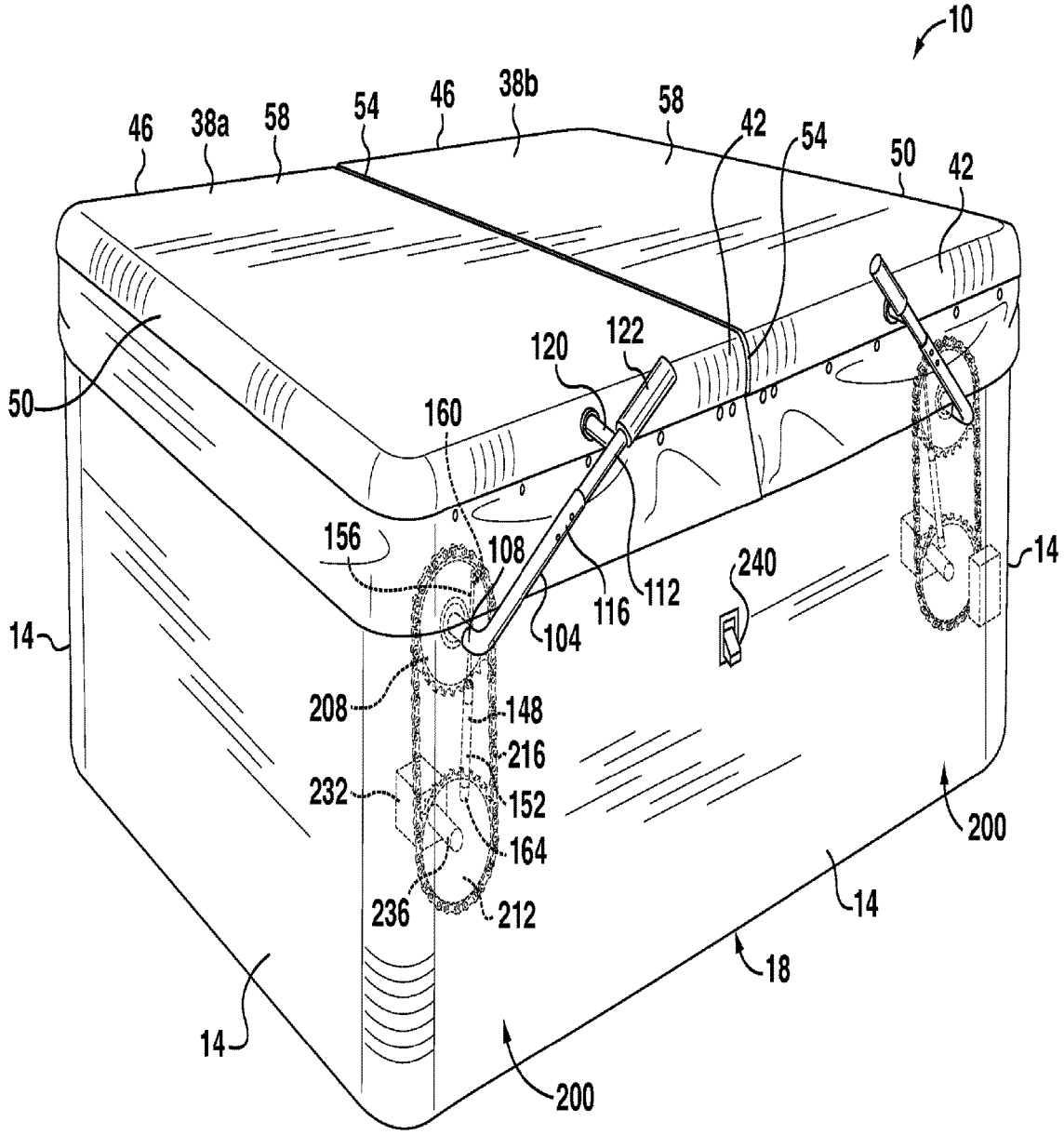
FIG. 17 shows a perspective view of a spa with another lift assembly and a cover in a closed position, in accordance with another embodiment.
Figure 18:
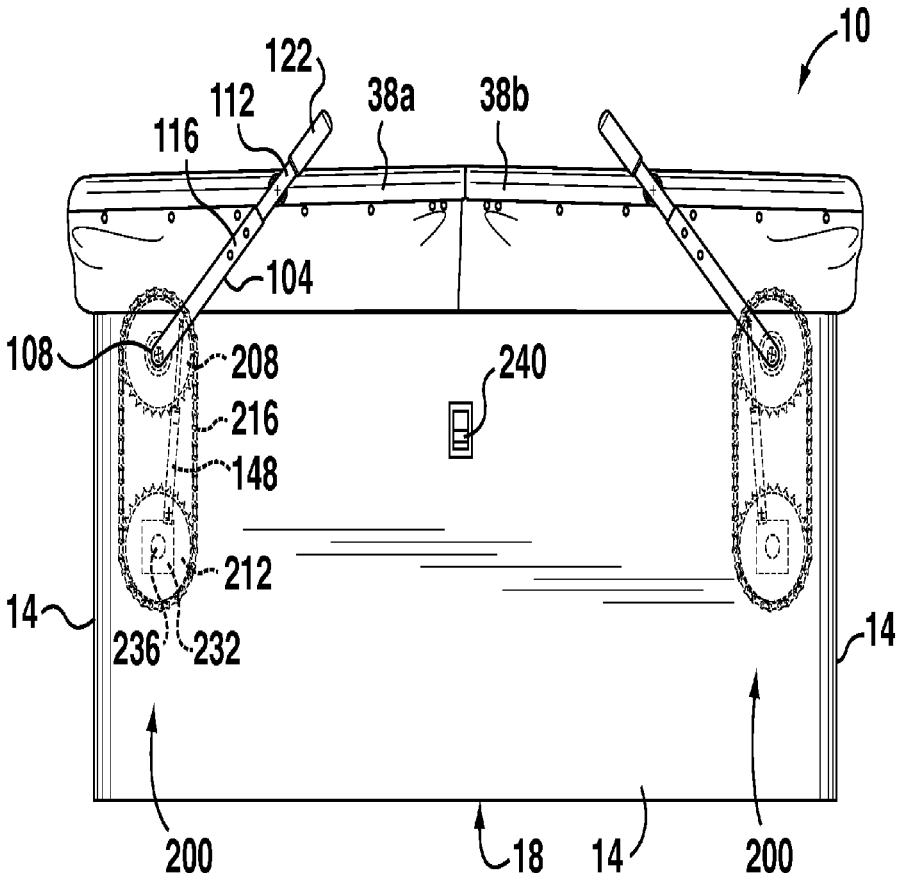
FIG. 18 shows a front elevation view of the spa of FIG. 17 in the closed position.
Figure 19A:
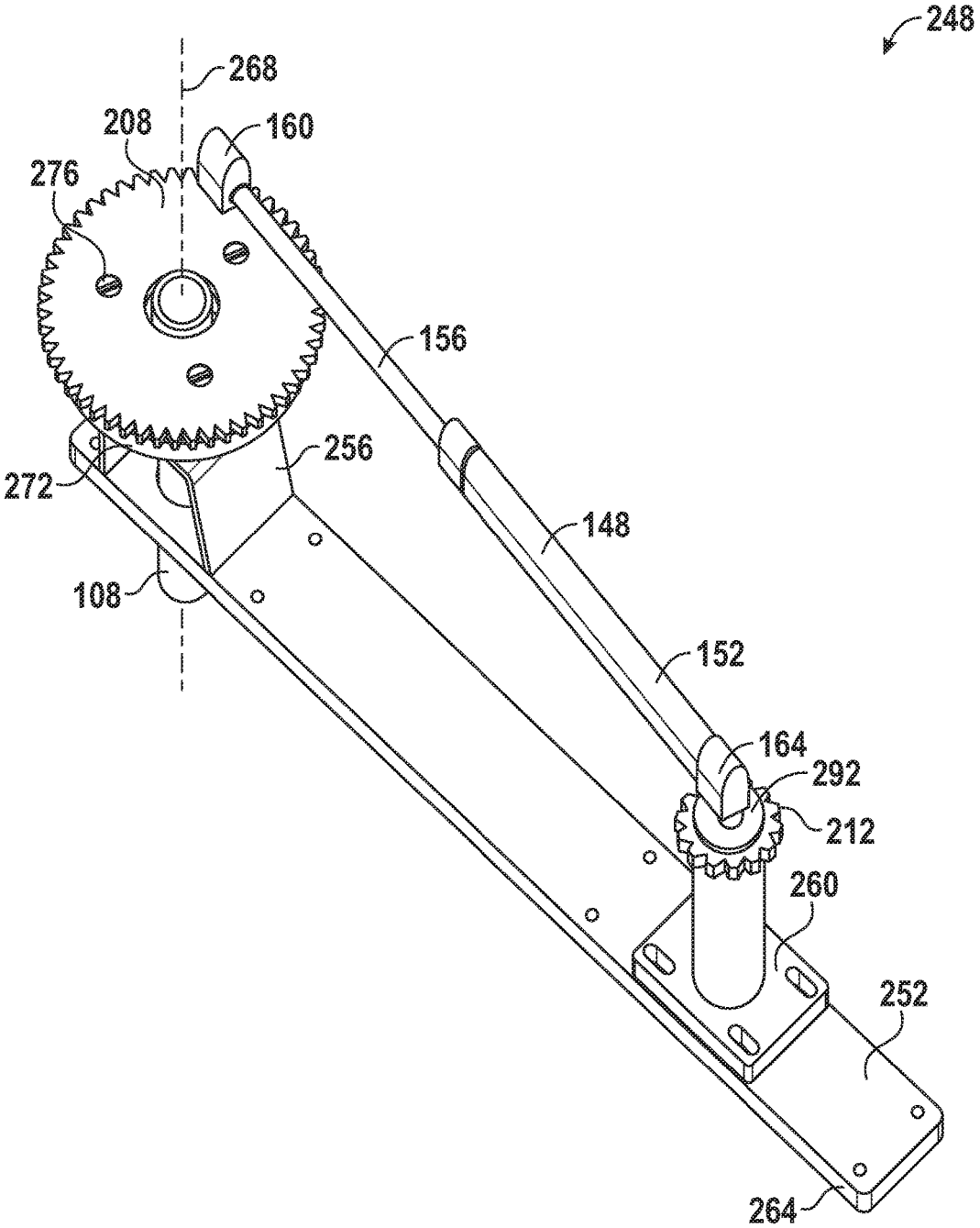
FIG. 19A shows a rear perspective view of a drive subassembly, in accordance with at least one embodiment.
Figure 19B:
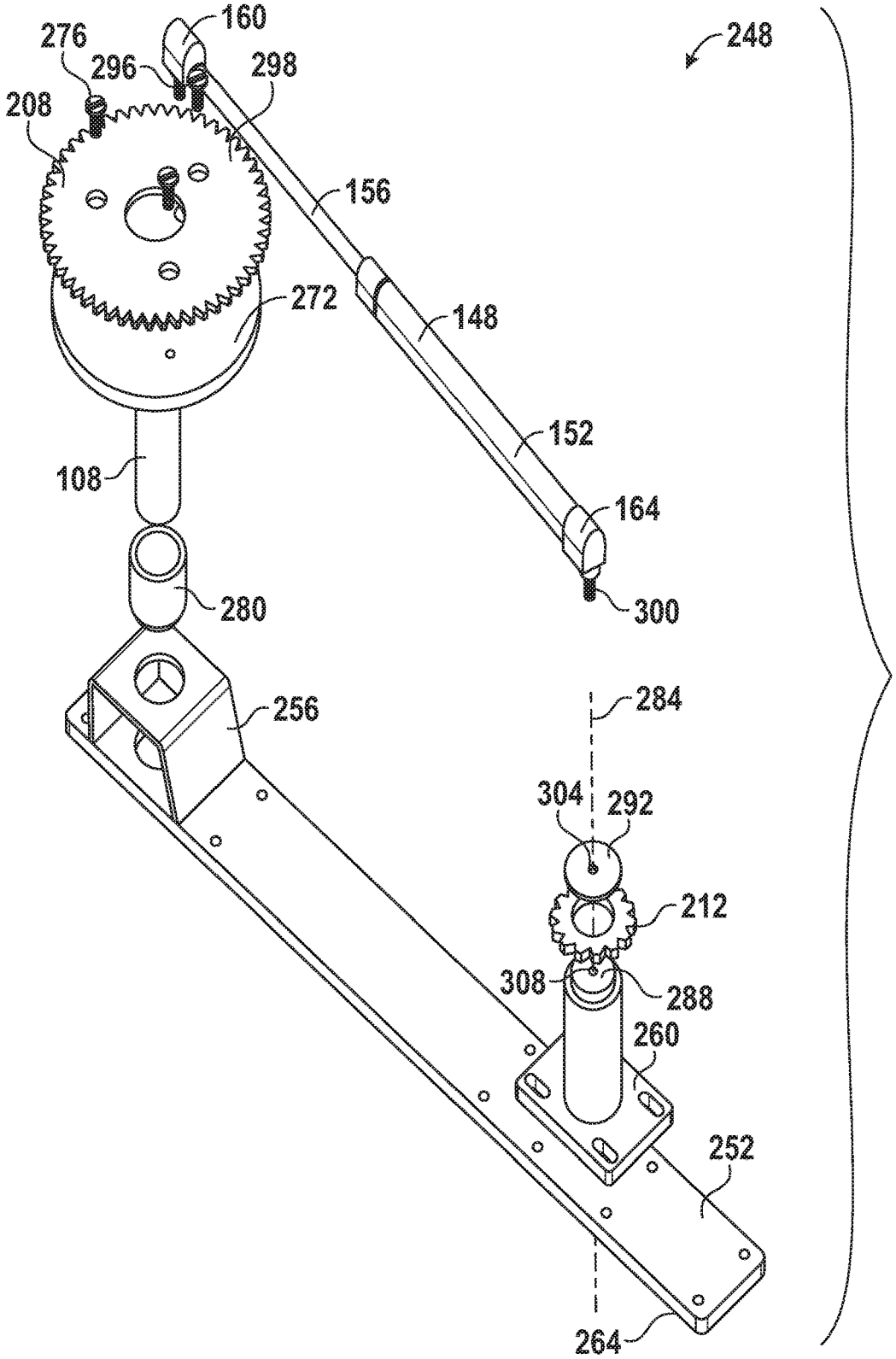
FIG. 19B shows an exploded view of the drive subassembly of FIG. 19A.
Figure 19C:
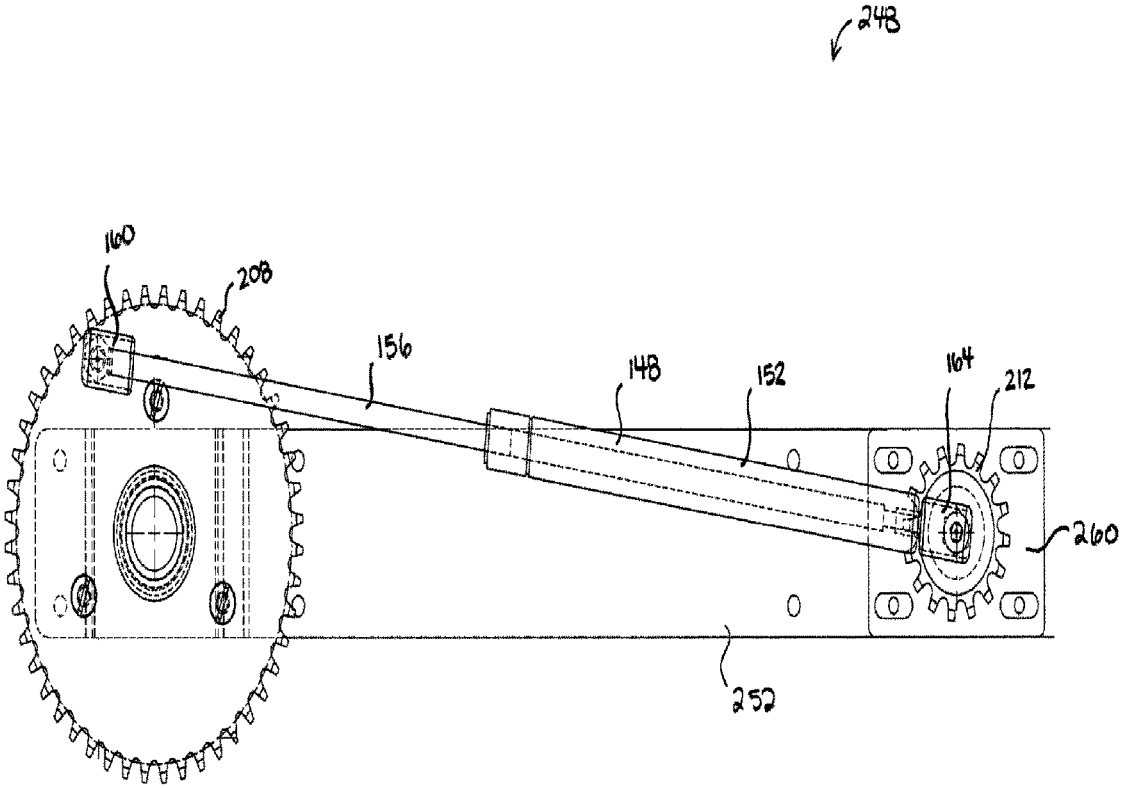
FIG. 19C shows a rear elevation view of the drive subassembly of FIG. 19A.
Figure 19D:
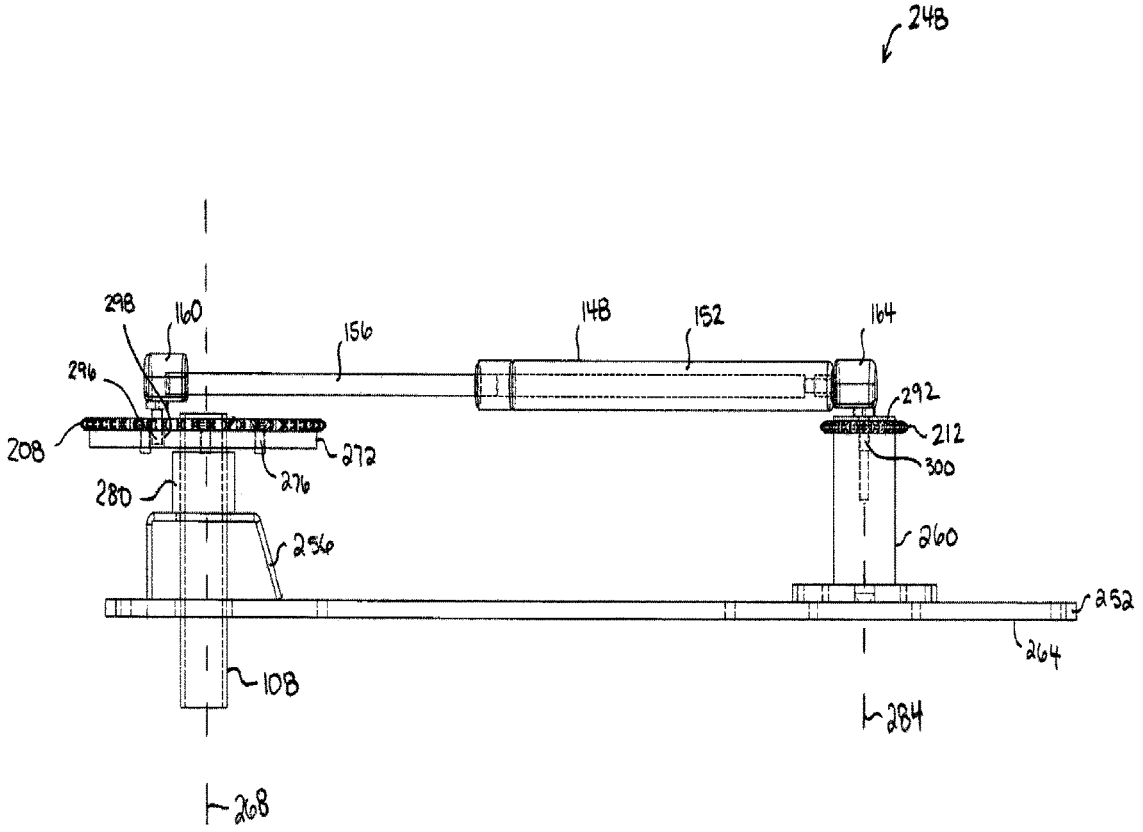
FIG. 19D shows a top plan view of the drive subassembly of FIG. 19A.

Referring to FIGS. 17 and 18, linear motor 220 may be substituted by a rotary motor 232 having a rotary drive shaft 236 drivingly connected to second sprocket 212. In use, motor 232 may be operable to rotate drive shaft 236 to rotate second sprocket 212 thus rotating first sprocket 208 between the open and closed positions.

Preferably, the rotator (e.g. motor 220 or 232) of lift assembly 200 is remotely operable by a user-operable actuator 240 (e.g. switch, or button). The actuator 240 may be mounted to spa 10 as shown or positioned remotely from spa 10. Further, the actuator 240 may be electrically connected to the rotator by wire or wireless for automatic operation of the rotator. For example, actuator 240 may be a handheld remote control. This may permit cover 38 to be remotely moved between the open and closed positioned. This may be especially convenient when spa 10 is located outdoors and the ambient temperature is cold. For example, users may be able to open cover 38 while standing indoors, then quickly run into spa 10 outdoors, and vice versa.

Reference is now made to FIGS. 19A-19D, which show a drive subassembly 248 in accordance with at least one embodiment. In some embodiments, drive subassembly 248 is applied to the embodiments of FIGS. 15-18 for example.

As exemplified, drive subassembly 248 may include first and second sprockets 208 and 212, spring 148, base 252, and first and second brackets 256 and 260. Base 252 may include a front surface 264 which may be mounted in facing relation to sidewall 14 of spa 100 (see FIG. 15) in any suitable fashion. As shown, first sprocket 208 may be positioned behind base 252. Lever arm first end 108 may extend through an aperture in base 252 for coupling with first sprocket 208 for concentric rotation with first sprocket 208 about first sprocket axis 268. For example, first sprocket 208 may be rigidly connected to a mounting plate 272 and lever arm first end 108 may be connected to mounting plate 272 as shown. First sprocket 208 may be rigidly connected to mounting plate 272 in any suitable fashion, such as by mechanical fasteners 276, welds, or rivets for example.

In some embodiments, lever arm first end 108 may be supported by bearings 280 to promote smooth rotation. As illustrated, bearings 280 may be mounted to first bracket 256 in front of mounting plate 272 concentric with axis 268. In alternative embodiments, drive subassembly 248 may not have bearings for supporting lever arm first end 108. For example, base 252 and/or first bracket 256 may support lever arm first end 108 during rotation.

In the illustrated example, second sprocket 212 may be positioned behind base 252. For example, second bracket 260 may be rigidly fastened to second bracket 260, and second sprocket 212 may be mounted for rotation atop second bracket 260 in spaced apart relation to base 252. As exemplified, second bracket 260 may have an axis 284 of rotation which is parallel and spaced apart from first sprocket axis 268. As shown, second bracket 260 may include a rearwardly extending shaft 288 upon which second sprocket 212 may be supported for rotation about axis 284.

Second sprocket 212 may be retained on second sprocket 212 in any suitable fashion. For example, a cover 292 may be connected to second bracket 260 in overlapping relation to second sprocket 212 for retaining second sprocket 212 on shaft 288. Cover 292 may be immovably connected to second bracket 260, or cover 292 may be rotatable with second bracket 260 about axis 284.

Spring first end 160 may be connected to first sprocket 208 radially outboard of first sprocket axis 268. As shown, spring first end 160 may include a mounting pin 296 which is retained in an opening 298 of first sprocket 208. As shown, opening 298 may be positioned radially outboard of first sprocket axis 268.

Second end 164 of spring 148 may be connected to second bracket 260. For example, second end 168 may be connected to one or both of cover 292 and shaft 288. In the illustrated embodiment, second end 164 includes a mounting pin 300 which extends through openings 304 and 308 of cover 292 and 288 collinearly with axis 284. This may permit second end 168 to remain stationary as second sprocket 212 and/or cover 292 rotate about axis 284.

As described with reference to FIGS. 15-18, first and second sprockets 208 and 212 may be drivingly coupled by a chain, and optionally driven to rotate by a rotary or linear motor for rotating lever arm first end 108.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A method of operating a cover for a spa, the method comprising the steps of:

positioning a cover atop a base of the spa, the base supporting a shell configured to contain a volume of water; and equipping the spa with a lift assembly, including:

pivotally connecting a first end of a lever arm to the base;

pivotally connecting a second end of the lever arm to the cover;

positioning a resilient spring interior to the base;

operatively connecting a first end of the resilient spring to the lever arm; and connecting a second end of the resilient spring to the base;

wherein the lever arm is configured for rotation to effect movement of the cover between a closed position in which the cover rests on the b as e, and an open position in which the cover is positioned adjacent to a sidewall of the base; and wherein the resilient spring is positioned so that in the open position of the cover, the resilient spring urges the lever arm to rotate toward the closed position of the cover, and in the closed position of the lever arm, the resilient spring urges the lever arm to rotate toward the open position of the cover; and wherein the first end of the resilient spring is connected to the lever arm and the second end of the resilient spring is connected to the base at points such that the resilient spring extends generally vertically.

2. The method according to claim 1, wherein:

the second end of the resilient spring is connected to the base at a point below a point where the first end of the lever arm is pivotally connected to the base.

3. The method according to claim 2, wherein:

the step of equipping the spa with the lift assembly further includes positioning a driving member interior to the base and coupling the driving member to the first end of the lever arm for rotation with the lever arm; and wherein the first end of the resilient spring is connected to the driving member.

4. The method according to claim 3, wherein:

the driving member is a circular disk.

5. The method according to claim 4, wherein:

the first end of the resilient spring is coupled to the disk at a position radially outboard of an axis of rotation of the disk.

6. A method of operating a cover for a spa, the method comprising the steps of:

positioning a cover atop a base of the spa;

equipping the spa with a lift assembly, including:

pivotally connecting a first end of a lever arm to the base;

pivotally connecting a second end of the lever arm to the cover;

positioning a resilient spring interior to the base;

operatively connecting a first end of the resilient spring to the lever arm; and connecting a second end of the resilient spring to the base;

wherein the lever arm is configured for rotation to effect movement of the cover between a closed position in which the cover rests on the base, and an open position in which the cover is positioned adjacent to a sidewall of the base; and wherein the resilient spring is positioned so that in the open position of the cover, the resilient spring urges the lever arm to rotate toward the closed position of the cover, and in the closed position of the lever arm, the resilient spring urges the lever arm to rotate toward the open position of the cover;

wherein the second end of the resilient spring is connected to the base at a point below a point where the first end of the lever arm is pivotally connected to the base;

wherein the step of equipping the spa with the lift assembly further includes positioning a driving member interior to the base and coupling the driving member to the first end of the lever arm for rotation with the lever arm;

wherein the first end of the resilient spring is connected to the driving member;

wherein the driving member is a sprocket; and the step of equipping the spa with the lift assembly further includes positioning a motor interior to the base and drivingly coupling a chain to the sprocket and to the motor.

7. A method of operating a cover for a spa, the method comprising the steps of:

positioning a cover atop a base of the spa;

equipping the spa with a lift assembly, including:

pivotally connecting a first end of a lever arm to the base;

pivotally connecting a second end of the lever arm to the cover;

positioning a resilient spring interior to the base;

operatively connecting a first end of the resilient spring to the lever arm; and connecting a second end of the resilient spring to the base;

wherein the lever arm is configured for rotation to effect movement of the cover between a closed position in which the cover rests on the base, and an open position in which the cover is positioned adjacent to a sidewall of the base; and wherein the resilient spring is positioned so that in the open position of the cover, the resilient spring urges the lever arm to rotate toward the closed position of the cover, and in the closed position of the lever arm, the resilient spring urges the lever arm to rotate toward the open position of the cover; and rotating the lever arm to move the cover from the closed position to the open position;

wherein in at least one position between the closed position and the open position, a direction of the force exerted by the resilient spring on the lever arm extends through a point where the first end of a lever arm is connected to the base.

8. The method according to claim 1, wherein:

the resilient spring is a pneumatic spring having a pneumatic cylinder and a piston rod.

9. The method according to claim 1, wherein:

the lever arm is connected to the base and to the cover such that the lever arm extends at an angle of approximately 30 degrees to 70 degrees from vertical when the cover is in the closed position.

10. The method according to claim 9, wherein:

the lever arm is connected to the base and to the cover such that the lever arm extends at an angle of approximately 45 degrees to 120 degrees from vertical when the cover is in the open position.

11. The method according to claim 1, wherein:

the resilient spring is positioned interior to said base laterally inboard an outer edge of said shell and beneath said shell.

* * * * *